US009272511B2

(12) United States Patent
Menzel

(10) Patent No.: US 9,272,511 B2
(45) Date of Patent: Mar. 1, 2016

(54) METHOD, APPARATUS, AND SYSTEM TO PROVIDE MULTI-PULSE WAVEFORMS WITH MENISCUS CONTROL FOR DROPLET EJECTION

(71) Applicant: FUJIFILM Dimatix, Inc., Lebanon, NH (US)

(72) Inventor: Christoph Menzel, New London, NH (US)

(73) Assignee: FUJIFILM DIMATIX, INC., Lebanon, NH (US)

( * ) Notice: Subject to any disclaimer, the term of this patent is extended or adjusted under 35 U.S.C. 154(b) by 0 days.

(21) Appl. No.: 13/966,177

(22) Filed: Aug. 13, 2013

(65) Prior Publication Data

US 2015/0049136 A1 Feb. 19, 2015

(51) Int. Cl.
*B41J 29/38* (2006.01)
*B41J 2/045* (2006.01)

(52) U.S. Cl.
CPC ..... *B41J 2/04588* (2013.01); *B41J 2/04526* (2013.01); *B41J 2/04581* (2013.01); *B41J 2/04596* (2013.01)

(58) Field of Classification Search
CPC . B41J 2/04596; B41J 2/04588; B41J 2/04526
See application file for complete search history.

(56) References Cited

U.S. PATENT DOCUMENTS

| | | | | |
|---|---|---|---|---|
| 4,523,201 | A * | 6/1985 | Liker | 347/11 |
| 5,138,333 | A * | 8/1992 | Bartky et al. | 347/11 |
| 2002/0001015 | A1 | 1/2002 | Kojima et al. | |
| 2005/0001864 | A1 * | 1/2005 | Sohn et al. | 347/11 |
| 2005/0068353 | A1 * | 3/2005 | Nishiwaki et al. | 347/9 |
| 2009/0289983 | A1 * | 11/2009 | Letendre et al. | 347/11 |
| 2011/0096114 | A1 * | 4/2011 | Letendre et al. | 347/11 |
| 2011/0141172 | A1 * | 6/2011 | Menzel et al. | 347/11 |
| 2012/0062629 | A1 | 3/2012 | Kim et al. | |

FOREIGN PATENT DOCUMENTS

WO WO-2009/080684 7/2009

OTHER PUBLICATIONS

Notification of Transmittal of the International Search Report and the Written opinion of the International Searching Authority for PCT/US2014/043896 mailed Oct. 20, 2014, 12 pages.

* cited by examiner

*Primary Examiner* — Shelby Fidler
(74) *Attorney, Agent, or Firm* — Blakely, Sokoloff, Taylor & Zafman LLP

(57) ABSTRACT

A method, apparatus, and system are described herein for driving a droplet ejection device with multi-pulse waveforms. In one embodiment, a method for driving a droplet ejection device having an actuator includes applying a multi-pulse waveform with a drop-firing portion having at least one drive pulse and a non-drop-firing portion to an actuator of the droplet ejection device. The non-drop-firing portion includes a jet straightening edge having a droplet straightening function and at least one cancellation edge having an energy canceling function. The at least drive pulse causes the droplet ejection device to eject a droplet of a fluid.

21 Claims, 12 Drawing Sheets

METHOD, APPARATUS, AND SYSTEM TO PROVIDE MULTI-PULSE WAVEFORMS WITH MENISCUS CONTROL FOR DROPLET EJECTION

TECHNICAL FIELD

Embodiments of the present invention relate to droplet ejection, and more specifically to using multi-pulse waveforms for meniscus control features.

BACKGROUND

Droplet ejection devices are used for a variety of purposes, most commonly for printing images on various media. Droplet ejection devices are often referred to as ink jets or ink jet printers. Drop-on-demand droplet ejection devices are used in many applications because of their flexibility and economy. Drop-on-demand devices eject one or more droplets in response to a specific signal, usually an electrical waveform that may include a single pulse or multiple pulses. Different portions of a multi-pulse waveform can be selectively activated to produce the droplets.

Droplet ejection devices typically include a fluid path from a fluid supply to a nozzle path. The nozzle path terminates in a nozzle opening from which droplets are ejected. Each ink jet has a natural frequency which is related to the inverse of the resonance period of a sound wave propagating through the length of the ejector (or jet). The jet natural frequency can affect many aspects of jet performance. For example, the jet natural frequency typically affects the frequency response of the printhead. Typically, the jet velocity remains near a target velocity for a range of frequencies from substantially less than the natural frequency up to about 25% of the natural frequency of the jet. As the frequency increases beyond this range, the jet velocity begins to vary by increasing amounts. This variation is caused, in part, by residual pressures and flows from the previous drive pulse(s). These pressures and flows interact with the current drive pulse and can cause either constructive or destructive interference, which leads to the droplet firing either faster or slower than it would otherwise fire.

One prior ink jetting approach uses a pulse string followed by a cancelling pulse. The cancelling pulse is a shortened pulse that is timed so that the resulting pressure pulses arrive at the nozzle out of phase with the residual pressure from previous pulses. Given that jets will have a dominant resonant frequency, the cancellation features are timed in units of resonance period Tc.

Droplet ejection devices need to generate drops sustainably, obtain a required drop volume, deliver material accurately, and achieve a desired delivery rate. Drop placement errors with respect to a target degrade image quality on the target. FIG. 1 illustrates different types of drop placement errors. A drop 121 is fired through a nozzle plate 110 towards a target 130. Vertical line 171 represents an ideal straight drop trajectory. However, a nozzle error 141 results from a misalignment of the nozzle with respect to the target. Vertical line 180 represents a straight drop trajectory from the nozzle to the target with this line being orthogonal to the nozzle plate 110. An angle theta formed between the vertical line 180 and the actual trajectory 190 of the drop represents the jet trajectory error 151. A total drop placement error 161 equals the combination of nozzle placement error and jet trajectory error.

BRIEF DESCRIPTION OF THE DRAWINGS

The present invention is illustrated by way of example, and not by way of limitation, in the figures of the accompanying drawings and in which.

DETAILED DESCRIPTION

A method, apparatus, and system are described herein for driving a droplet ejection device with multi-pulse waveforms. In one embodiment, a method for driving a droplet ejection device having an actuator includes applying a multi-pulse waveform with a drop-firing portion having at least one drive pulse and a non-drop-firing portion to an actuator of the droplet ejection device. The non-drop-firing portion includes a jet straightening edge having a droplet straightening function and at least one cancellation edge having an energy canceling function. The at least one drive pulse causes the droplet ejection device to eject a droplet of a fluid.

Multi-pulse waveforms need to perform a large number of functions together to deliver value. These functions may include providing various drop masses, maintaining the overall firing frequency, maintaining acceptable drop formation by avoiding satellite droplets, maintaining straightness of ejected droplets, ensuring droplets arrive at the target medium (e.g., paper, etc.) or substrate within a designated pixel, and controlling and stabilizing the meniscus post droplet breakoff. All these functions make potentially competing demands on waveforms. The waveforms of the present design enhance meniscus control and improve droplet formation.

The residual energy stored in an inkjet after a droplet has been fired has the potential to influence the characteristics of subsequent droplets. Given that droplet uniformity across all jetting conditions is valuable and needs to be maintained within some limit, this stored residual energy can reduce the inherent quality of a printhead. In practice, the influence of residual energy causes or contributes to velocity dependency on firing frequency, cross talk with the firing state of neighboring jets affecting an observation jet, jet straightness and stability in which a meniscus position at break-off of a droplet is in an undesirable position such as retracting into a nozzle causing a tail of the droplet to whip to the side.

The waveforms of the present application include a non-drop-firing portion to provide both of a droplet straightening function and an energy cancelling function. The droplet straightening function provided by a straightening edge causes a meniscus to bulge at a nozzle at droplet break-off. This causes a straight trajectory for the ejected droplet. The energy cancelling function is provided by a canceling edge or pulse that reduces meniscus motion at the nozzle. An edge of a waveform causes a rapid increase or decrease in voltage level along the approximately vertical edge of the waveform.

Figure 1:
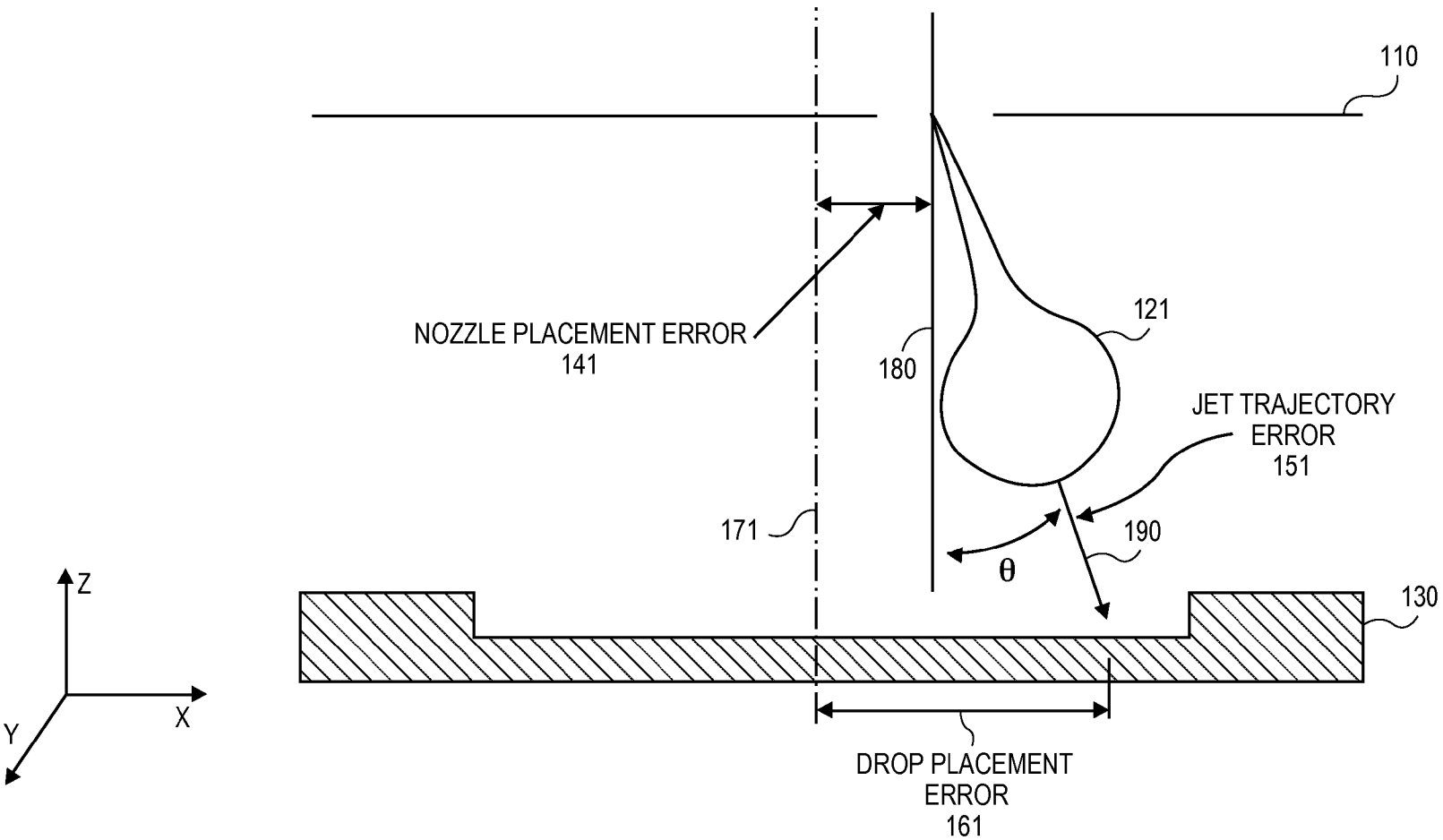
FIG. 1 (PRIOR ART)
FIG. 1 is a cross-sectional side view of a nozzle plate of an ink jet printhead in relation to a target in accordance with a conventional approach.
Figure 2:
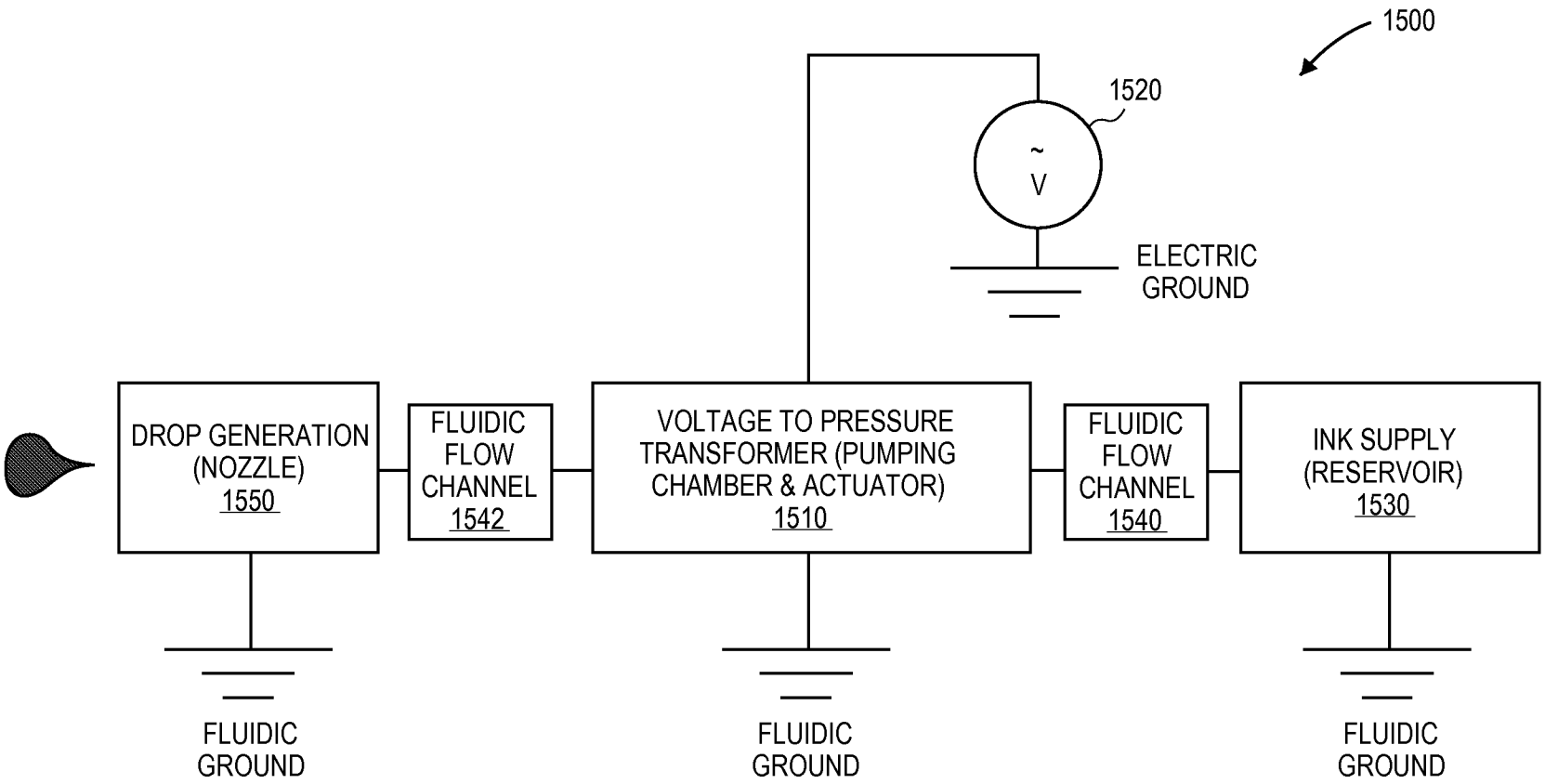
FIG. 2 illustrates a block diagram of an ink jet system in accordance with one embodiment.

FIG. 2 illustrates a block diagram of an ink jet system in accordance with one embodiment. The ink jet system 1500 includes a voltage source 1520 that applies a voltage to pressure transformer 1510 (e.g., pumping chamber and actuator), which may be a piezoelectric or heat transformer. An ink supply 1530 supplies ink to a fluidic flow channel 1540, which supplies ink to the transformer. The transformer provides the ink to a fluidic flow channel 1542. This fluidic flow channel allows pressure from the transformer to propagate to a drop generation device 1550 having orifices or nozzles and generate one or more droplets if one or more pressure pulses are sufficiently large. Ink level in the ink jet system 1500 is maintained through a fluidic connection to the ink supply 1530. The drop generation device 1550, transformer 1540, and ink supply 1530 are coupled to fluidic ground while the voltage supply is coupled to electric ground.

Figure 3:
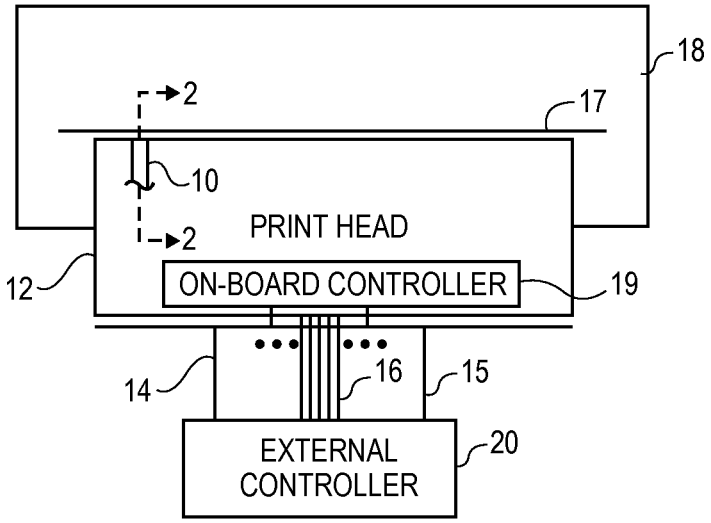
FIG. 3 is a piezoelectric ink jet print head in accordance with one embodiment.

FIG. 3 is a piezoelectric ink jet print head in accordance with one embodiment. As shown in FIG. 3, the 128 individual droplet ejection devices 10 (only one is shown on FIG. 3) of print head 12 are driven by constant voltages provided over supply lines 14 and 15 and distributed by on-board control circuitry 19 to control firing of the individual droplet ejection devices 10. External controller 20 supplies the voltages over lines 14 and 15 and provides control data and logic power and timing over additional lines 16 to on-board control circuitry 19. Ink jetted by the individual ejection devices 10 can be delivered to form print lines 17 on a substrate 18 that moves under print head 12. While the substrate 18 is shown moving past a stationary print head 12 in a single pass mode, alternatively the print head 12 could also move across the substrate 18 in a scanning mode.

Figure 4:
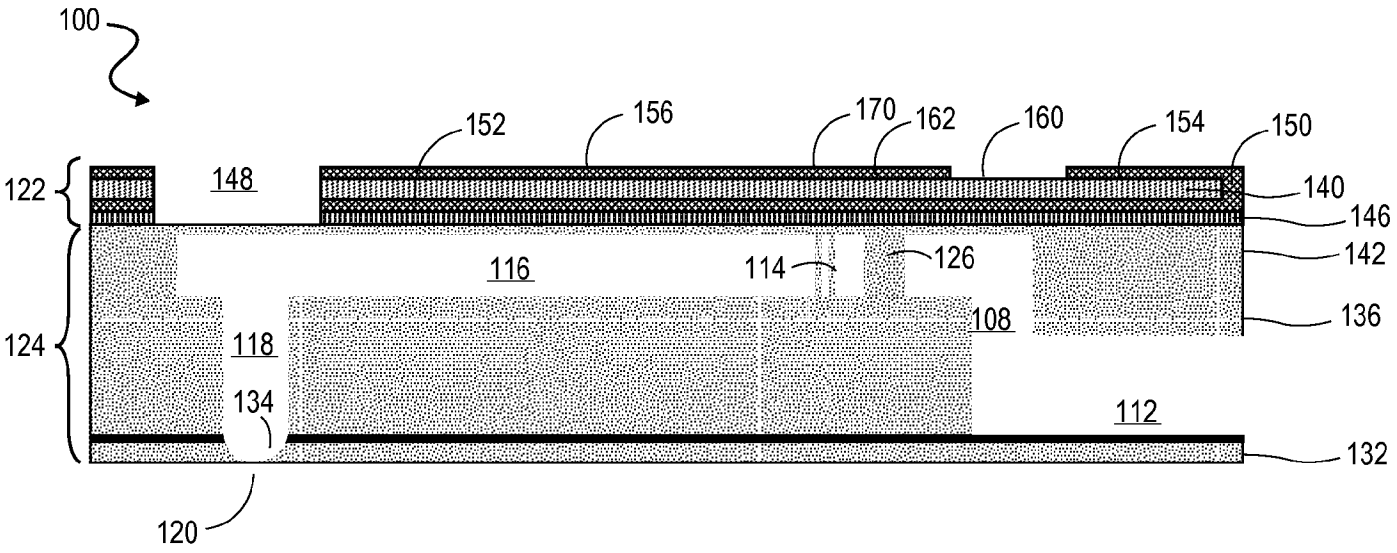
FIG. 4 illustrates a piezoelectric drop on demand printhead module for ejecting droplets of ink on a substrate to render an image in accordance with one embodiment.

FIG. 4 illustrates a piezoelectric drop on demand printhead module for ejecting droplets of ink on a substrate to render an image in accordance with one embodiment. The module has a series of closely spaced nozzle openings from which ink can be ejected. Each nozzle opening is served by a flow path including a pumping chamber where ink is pressurized by a piezoelectric actuator. Other modules may be used with the techniques described herein.

Referring to FIG. 4, which illustrates a cross-section through a flow path of a single jetting structure in a module 100, ink enters the module 100 through a supply path 112, and is directed by an ascender 108 to an impedance feature 114 and a pumping chamber 116. Ink flows around a support 126 prior to flowing through the impedance feature 114. Ink is pressurized in the pumping chamber by an actuator 122 and directed through a descender 118 to a nozzle opening 120 from which droplets are ejected.

The flow path features are defined in a module body 124. The module body 124 includes a base portion, a nozzle portion and a membrane. The base portion includes a base layer of silicon (base silicon layer 136). The base portion defines features of the supply path 112, the ascender 108, the impedance feature 114, the pumping chamber 116, and the descender 118. The nozzle portion is formed of a silicon layer 132. In one embodiment, the nozzle silicon layer 132 is fusion bonded to the silicon layer 136 of the base portion and defines tapered walls 134 that direct ink from the descender 118 to the nozzle opening 120. The membrane includes a membrane silicon layer 142 that is fusion bonded to the base silicon layer 136, opposite to the nozzle silicon layer 132.

In one embodiment, the actuator 122 includes a piezoelectric layer 140 that has a thickness of about 21 microns. The piezoelectric layer 140 can be designed with other thicknesses as well. A metal layer on the piezoelectric layer 140 forms a ground electrode 152. An upper metal layer on the piezoelectric layer 140 forms a drive electrode 156. A wrap-around connection 150 connects the ground electrode 152 to a ground contact 154 on an exposed surface of the piezoelectric layer 140. An electrode break 160 electrically isolates the ground electrode 152 from the drive electrode 156. The metallized piezoelectric layer 140 is bonded to the silicon membrane 142 by an adhesive layer 146. In one embodiment, the adhesive is polymerized benzocyclobutene (BCB) but may be various other types of adhesives as well.

The metallized piezoelectric layer 140 is sectioned to define active piezoelectric regions over the pumping chambers 116. In particular, the metallized piezoelectric layer 140 is sectioned to provide an isolation area 148. In the isolation area 148, piezoelectric material is removed from the region over the descender. This isolation area 148 separates arrays of actuators on either side of a nozzle array.

Figure 5:
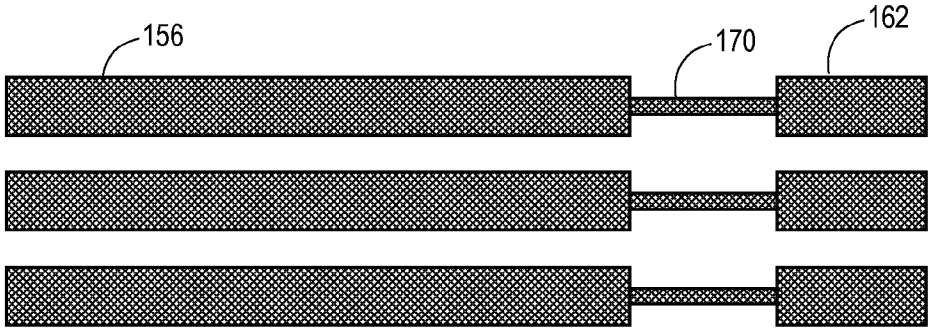
FIG. 5 illustrates a top view of a series of drive electrodes corresponding to adjacent flow paths in accordance with one embodiment.

FIG. 5 illustrates a top view of a series of drive electrodes corresponding to adjacent flow paths in accordance with one embodiment. Each flow path has a drive electrode 156 connected through a narrow electrode portion 170 to a drive electrode contact 162 to which an electrical connection is made for delivering drive pulses. The narrow electrode portion 170 is located over the impedance feature 114 and reduces the current loss across a portion of the actuator 122 that need not be actuated. Multiple jetting structures can be formed in a single printhead die. In one embodiment, during manufacture, multiple dies are formed contemporaneously.

A PZT member or element (e.g., actuator) is configured to vary the pressure of fluid in the pumping chambers in response to the drive pulses applied from the drive electronics. For one embodiment, the actuator ejects droplets of a fluid from a nozzle via the pumping chambers. The drive electronics are coupled to the PZT member. During operation of the printhead module, the actuators eject a droplet of a fluid from a nozzle. In one embodiment, the drive electronics are coupled to the actuator with the drive electronics driving the actuator by applying a multi-pulse waveform with a drop-firing portion having at least one drive pulse and a non-drop-firing portion with a jet straightening edge having a droplet straightening function and at least one cancellation edge having an energy canceling function. The drive electronics cause the droplet ejection device (e.g., apparatus) to eject a droplet of a fluid in response to the at least one drive pulse. The jet straightening edge having the droplet straightening function is applied to the actuator at approximately a break-off time of the droplet to cause a meniscus of fluid to have a convex shape, to protrude with respect to a nozzle of the apparatus, or to move towards the nozzle. The non-drop-firing portion of the multi-pulse waveform includes the jet straightening edge in a first position of the non-drop-firing portion following by the at least one cancellation edge in a second position of the non-drop-firing portion. Alternatively, the non-drop-firing portion of the multi-pulse waveform includes the at least one cancellation edge in a first position of the non-drop-firing portion followed by the jet straightening edge in a second position of the non-drop-firing portion. The non-drop-firing portion may include the jet straightening edge and two cancellation edges. The jet straightening edge causes a pressure response wave that is approximately in phase (i.e., in resonance) with respect to one or more pressure response waves caused by the at least one drive pulse. The pressure response waves of the two cancellation edges are approximately out of phase (i.e., in anti-resonance) with respect to the at least one drive pulse.

In another embodiment, a printhead includes an ink jet module that includes actuators to eject droplets of a fluid from corresponding pumping chambers and drive electronics that are coupled to the actuators. During operation the drive electronics drive an actuator by applying a multi-pulse waveform with a drop-firing portion having at least one drive pulse and a non-drop-firing portion with at least one jet straightening edge having a droplet straightening function and at least one cancellation edge having an energy canceling function. The drive electronics cause the actuator to eject a droplet of a fluid in response to the at least one drive pulse. The at least one jet straightening edge having the droplet straightening function is applied to the actuator at approximately a break-off time of the droplet to cause a meniscus of fluid to have a convex shape or to protrude with respect to a nozzle of the droplet ejection device. The non-drop-firing portion of the multi-pulse waveform includes the at least one jet straightening edge in a first position of the non-drop-firing portion following by the at least one cancellation edge in a second position of the non-drop-firing portion. In another embodiment, the non-drop-firing portion of the multi-pulse waveform includes the at least one cancellation edge in a first position of the non-drop-firing portion followed by the at least one jet straightening edge in a second position of the non-drop-firing portion.

The non-drop-firing portion may include one jet straightening edge and two cancellation edges. The at least one jet straightening edge may cause a pressure response wave that is approximately in phase (i.e., in resonance) with respect to pressure response waves caused by the at least one drive pulse. The pressure response waves of the two cancellation edges may be approximately out of phase (i.e., in anti-resonance) with respect to the pressure response wave(s) of the at least one drive pulse. Alternatively, the at least one jet straightening edge is not in resonance (e.g., pi/4 off of resonance) with respect to the at least one drive pulse.

Figure 6:
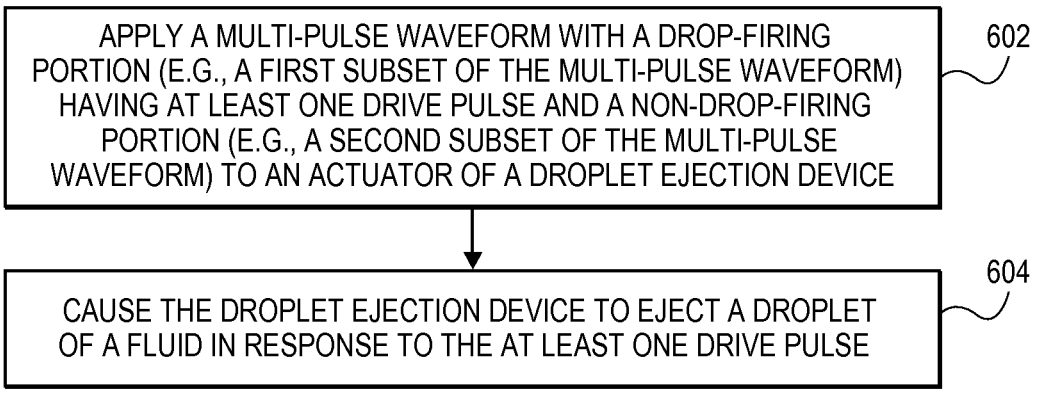
FIG. 6 illustrates a flow diagram of a process for driving at least one droplet ejection device with a multi-pulse waveform for meniscus control in accordance with one embodiment.

FIG. 6 illustrates a flow diagram of a process for driving at least one droplet ejection device with a multi-pulse waveform for meniscus control in accordance with one embodiment. In one embodiment, the process for driving the droplet ejection device includes applying a multi-pulse waveform with a drop-firing portion (e.g., a first subset of the multi-pulse waveform) having at least one drive pulse and a non-drop-firing portion (e.g., a second subset of the multi-pulse waveform) to an actuator of a droplet ejection device at block 602. The non-drop-firing portion includes a jet straightening edge having a droplet straightening function and at least one cancellation edge having an energy canceling function. The process further includes causing the droplet ejection device to eject a droplet of a fluid in response to the at least one drive pulse at block 604. The jet straightening edge having the droplet straightening function is applied to the actuator at approximately a break-off time when the droplet breaks off from the fluid in the nozzle. The jet straightening edge causes a meniscus of fluid of the droplet ejection device to have a convex shape or to protrude with respect to a nozzle of the droplet ejection device. In an embodiment, the meniscus has a convex shape and protrudes with respect to the nozzle.

The non-drop-firing portion of the multi-pulse waveform includes the jet straightening edge in a first position of the non-drop-firing portion followed by the at least one cancellation edge in a second position of the non-drop-firing portion. Alternatively, the non-drop-firing portion of the multi-pulse waveform includes the at least one cancellation edge in a first position of the non-drop-firing portion followed by the jet straightening edge in a second position of the non-drop-firing portion. The non-drop-firing portion may include the jet straightening edge and at least one cancellation edge (e.g., one cancellation edge, two cancellation edges, etc.).

In one embodiment, a pressure response wave of the jet straightening edge is in resonance (i.e., in phase) or approximately in resonance with respect to pressure wave(s) of the at least one drive pulse. The pressure response waves of the two cancellation edges are approximately in anti-resonance (i.e., out of phase) with respect to the pressure response waves of the at least one drive pulse. A peak voltage of the jet straightening edge may be less than a peak voltage of the at least one cancellation edge, which may be less than a peak voltage of the at least one drive pulse.

In another embodiment, the pressure response wave of the jet straightening edge is not in resonance with the pressure response wave(s) of the at least one drive pulse. The timing for the jet straightening edge is not completely related to resonance because the break-off time of the droplet is impacted by nozzle size and ink properties.

A cancellation edge or a cancellation pulse are each designed to not eject a droplet based on pressure response waves of the cancellation edge or cancellation pulse being out of phase (i.e., anti-resonance) with respect to pressure response waves caused by previous drive pulses. The cancellation edge or cancellation pulse also has a lower maximum voltage amplitude in comparison to drive pulses to avoid ejecting a droplet.

The droplet ejection device in the method 600 ejects droplets based on the first subset and the second subset of the waveform. The method 600 may also be performed with the waveform being applied to each droplet ejection device of a printhead.

In one embodiment, the droplet ejection device ejects additional droplets of the fluid in response to the pulses of the multi-pulse waveform or in response to pulses of additional multi-pulse waveforms. A waveform may include a series of sections that are concatenated together. Each section may include a certain number of samples that include a fixed time period (e.g., 1 to 3 microseconds) and associated amount of data. The time period of a sample is long enough for control logic of the drive electronics to enable or disable each jet nozzle for the next waveform section. In one embodiment, the waveform data is stored in a table as a series of address, voltage, and flag bit samples and can be accessed with software. A waveform provides the data necessary to produce a single sized droplet and various different sized droplets. For example, a waveform can operate at a frequency of 20 kilo-Hertz (kHz) and produce three different sized droplets by selectively activating different pulses of the waveform. These droplets are ejected at approximately the same target velocity.

Figure 8:
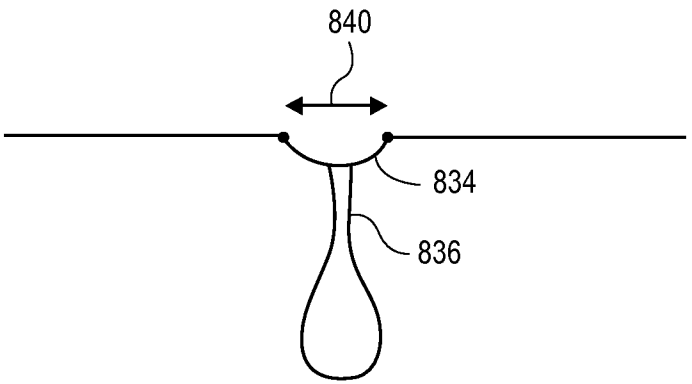
FIG. 8 illustrates a bulging (i.e., protruding) meniscus 834 and the tail 836 centered with respect to the nozzle opening 840 in accordance with one embodiment.
Figure 7:
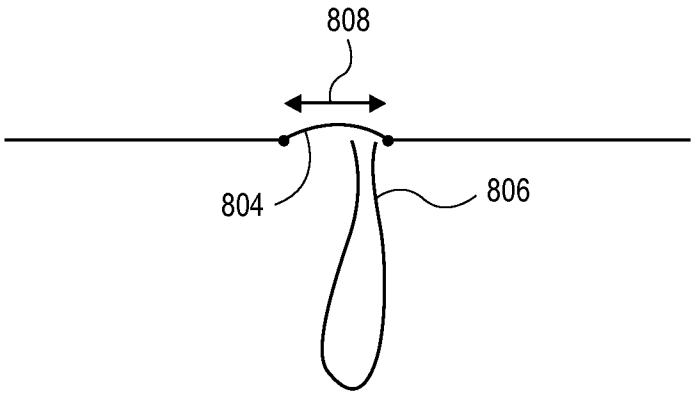
FIG. 7 (PRIOR ART)
FIG. 7 illustrates a retracting meniscus 804 having a tail 806 moving to one side of the nozzle opening 808 in accordance with a prior approach.

FIG. 7 illustrates a retracting meniscus 804 having a tail 806 moving to one side of the nozzle opening 808 in accordance with a prior approach. The application of a drive pulse to an actuator of a droplet ejection device can cause the retracting meniscus 804 to have a concave shape. FIG. 8 illustrates a bulging (i.e., protruding) meniscus 834 and the tail 836 centered with respect to the nozzle opening 840 in accordance with one embodiment. The application of a drop-firing portion and a non-drop-firing portion of a waveform to an actuator of a droplet ejection device can cause the bulging (i.e., protruding) meniscus 834 having a convex shape. It is desirable for the tail of the drop to be centered with respect to the nozzle opening to minimize the trajectory drop error. This will improve image quality and product quality. Temperature increases may change meniscus characteristics that enable more favorable symmetric fluid wetting of the jet nozzles. The straightening pulse additionally changes meniscus bounce to provide more favorable wetting.

Figure 9:
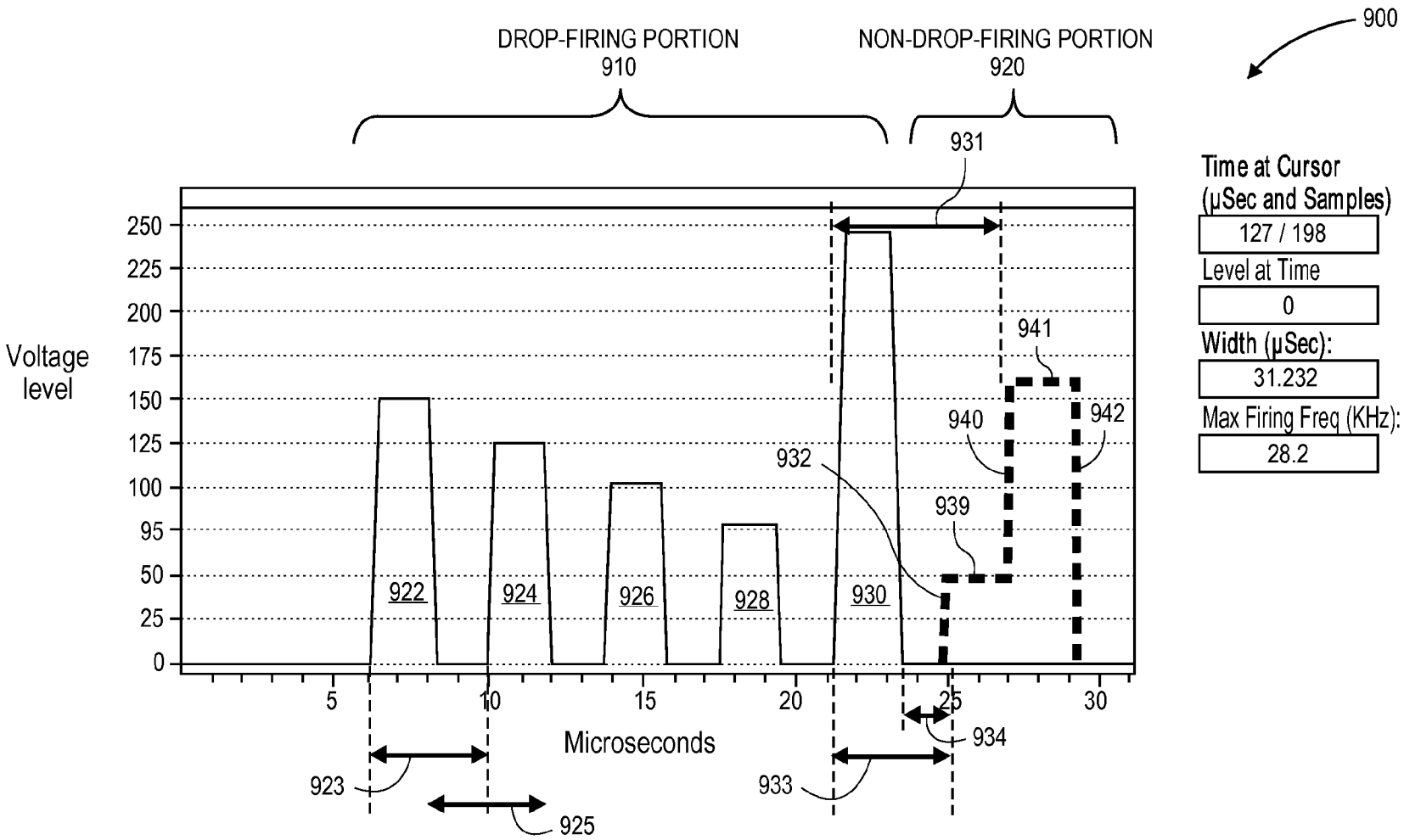
FIG. 9 shows a waveform 900 with a drop-firing portion and a non-drop-firing portion in accordance with one embodiment.

FIG. 9 shows a waveform 900 with a drop-firing portion and a non-drop-firing portion in accordance with one embodiment. The drop-firing portion 910 (e.g., a first subset of the multi-pulse waveform) 900 includes drive pulses 922, 924, 926, 928, and 930. The non-drop-firing portion 920 (e.g., a second subset of the multi-pulse waveform) includes a jet straightening edge 932 having a droplet straightening function and cancellation edges 940 and 942 having an energy canceling function. The drive pulses cause the droplet ejection device to eject a droplet of a fluid. A time period 923 is a time period from a first edge of pulse 922 to a first edge of pulse 924 such that pressure response wave(s) associated with the pulse 922 combine constructively with pressure response wave(s) associated with the pulse 924. A time period 925 is a time period from a second edge of pulse 922 to a second edge of pulse 924. These time periods from one firing pulse to a subsequent firing pulse may be approximately a resonance time period. The time period may not exactly be at resonance. A time period 933 is a time period from a first edge of pulse 930 to a jet straightening edge 932 such that pressure response wave(s) associated with the pulse 930 combine constructively with pressure response wave(s) associated with the edge 932. An anti-resonance period 931 is a time period from a first edge of pulse 930 to a cancellation edge 940 such that pressure response wave(s) associated with the pulse 930 combine destructively with pressure response wave(s) associated with the edge 940. The jet straightening edge 932 having the droplet straightening function is applied to the actuator at approximately a break-off time of the droplet to cause a meniscus of fluid of the droplet ejection device to have a desirable position (e.g., convex shape, convex shape inside nozzle that is moving towards being outside of nozzle, protruding with respect to a nozzle of the droplet ejection device). FIG. 8B illustrates one example of a favorable meniscus position.

In one embodiment, a jet straightening edge delay 934 is a time period from a second edge of pulse 930 and the jet straightening edge 932. A cancel edge delay 939 is a time period from the jet straightening edge 932 to cancellation edge 940. A cancel edge delay 941 is a time period from the cancellation edge 940 to cancellation edge 942. In another embodiment, the straightening edge is a straightening pulse that is separate from a cancellation pulse. The cancellation edge(s) or pulse can occur prior to the straightening edge or pulse.

Figure 10:
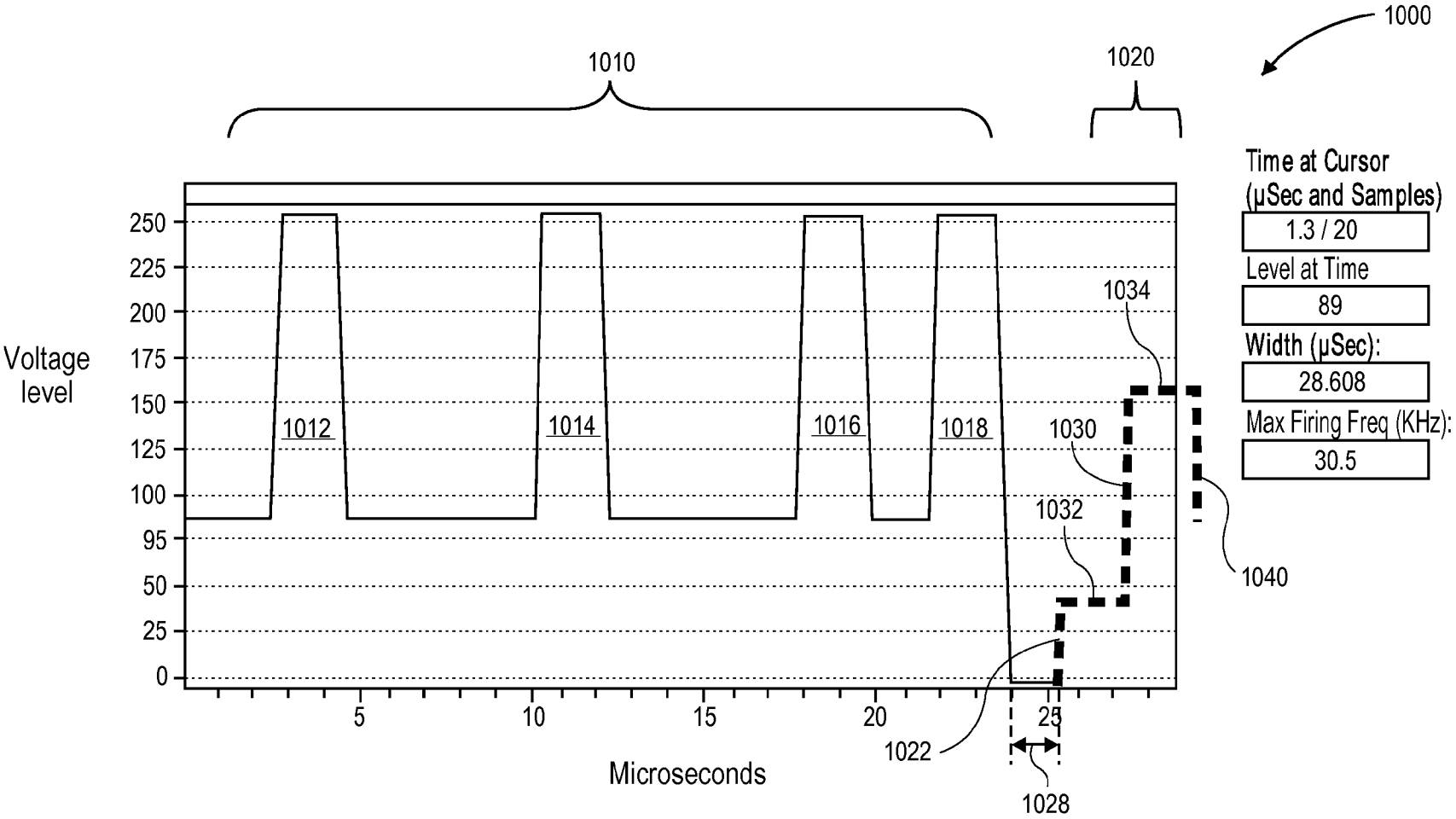
FIG. 10 shows a waveform 1000 with a drop-firing portion and a non-drop-firing portion in accordance with another embodiment.

FIG. 10 shows a waveform 1000 with a drop-firing portion and a non-drop-firing portion in accordance with one embodiment. The drop-firing portion 1010 (e.g., a first subset of the multi-pulse waveform) includes drive pulses 1012, 1014, 1016, and 1018. The non-drop-firing portion 1020 (e.g., a second subset of the multi-pulse waveform) includes a jet straightening edge 1022 having a droplet straightening function and cancellation edges 1030 and 1040 having an energy canceling function. The drive pulses cause the droplet ejection device to eject a droplet of a fluid. The jet straightening edge 1022 is fired in resonance with a first edge of the drive pulse 1018. The cancellation edges 1030 and 1040 are fired in anti-resonance with a first edge of the drive pulse 1018. The jet straightening edge 1022 having the droplet straightening function is applied to the actuator at approximately a break-off time of the droplet to cause a meniscus of fluid of the droplet ejection device to have a desirable position (e.g., convex shape, convex shape inside nozzle that is moving towards being outside of nozzle, protruding with respect to a nozzle of the droplet ejection device). FIG. 8B illustrates one example of a favorable meniscus position.

In one embodiment, a jet straightening edge delay 1028 is a time period from a second edge of pulse 1018 and the jet straightening edge 1022. A cancel edge delay 1032 is a time period from the jet straightening edge 1022 to cancellation edge 1030. A cancel edge delay 1034 is a time period from the cancellation edge 1030 to cancellation edge 1040. In another embodiment, the straightening edge is a straightening pulse that is separate from a cancellation pulse. The cancellation edge(s) or pulse can occur prior to the straightening edge or pulse.

Figure 11:
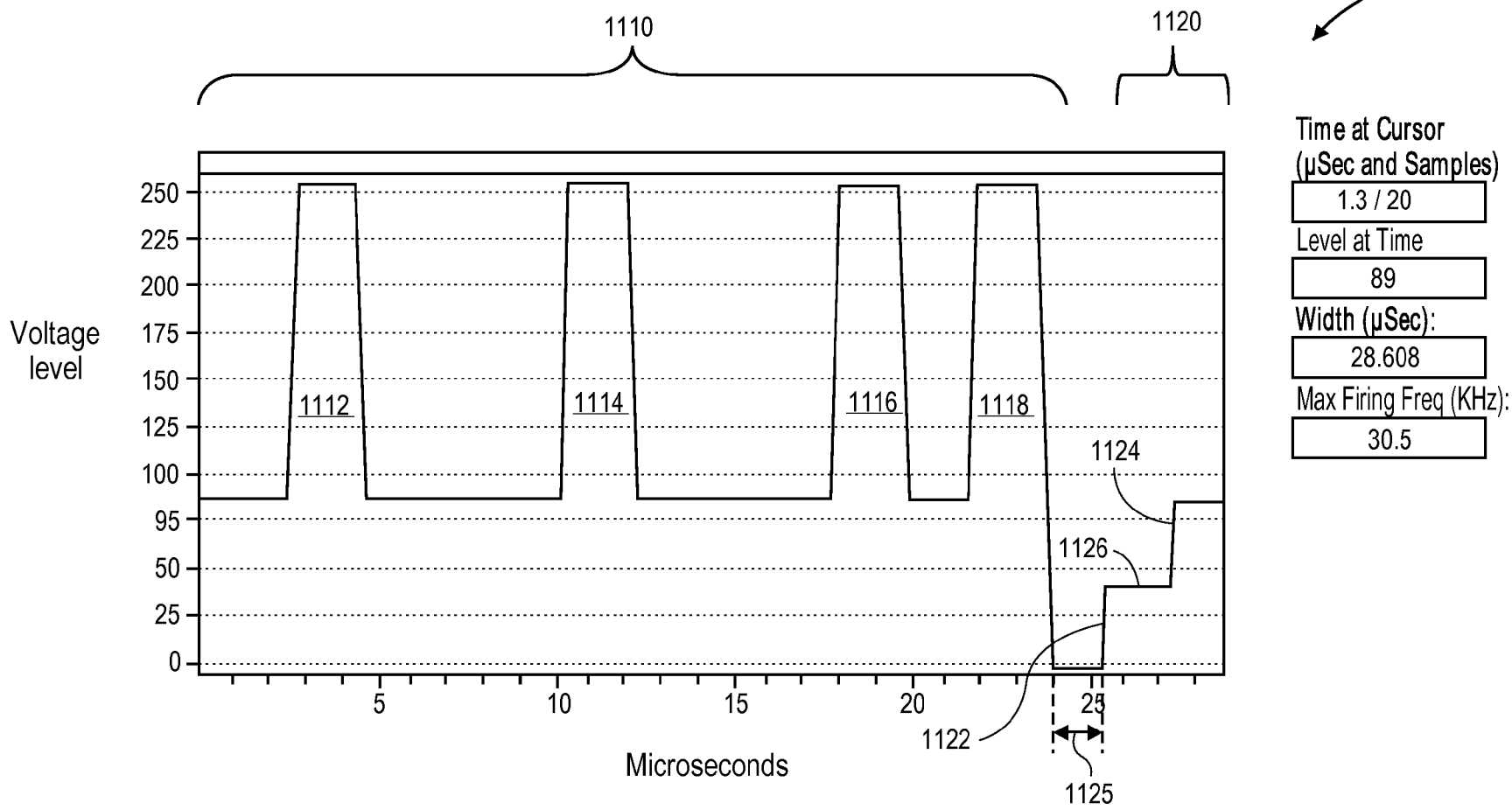
FIG. 11 shows a waveform 1100 with a drop-firing portion and a non-drop-firing portion in accordance with another embodiment.

FIG. 11 shows a waveform 1100 with a drop-firing portion and a non-drop-firing portion in accordance with one embodiment. The drop-firing portion 1110 (e.g., a first subset of the multi-pulse waveform) includes drive pulses 1112, 1114, 1116, and 1118. The non-drop-firing portion 1120 (e.g., a second subset of the multi-pulse waveform) includes a jet straightening edge 1122 having a droplet straightening function and a cancellation edge 1124 having an energy canceling function. The drive pulses cause the droplet ejection device to eject a droplet of a fluid. The jet straightening edge 1122 is fired in resonance with a first edge of the drive pulse 1118. The cancellation edge 1124 is fired in anti-resonance with a first edge of the drive pulse 1118. The jet straightening edge 1122 having the droplet straightening function is applied to the actuator at approximately a break-off time of the droplet to cause a meniscus of fluid of the droplet ejection device to have a desirable position (e.g., convex shape, convex shape inside nozzle that is moving towards being outside of nozzle, protruding with respect to a nozzle of the droplet ejection device). FIG. 8B illustrates one example of a favorable meniscus position.

In one embodiment, a jet straightening edge delay 1125 is a time period from a second edge of pulse 1118 and the jet straightening edge 1122. A cancel edge delay 1126 is a time period from the jet straightening edge 1122 to cancellation edge 1124. In another embodiment, the straightening edge is a straightening pulse that is separate from a cancellation pulse. The cancellation edge(s) or pulse can occur prior to the straightening edge or pulse.

Figure 12:
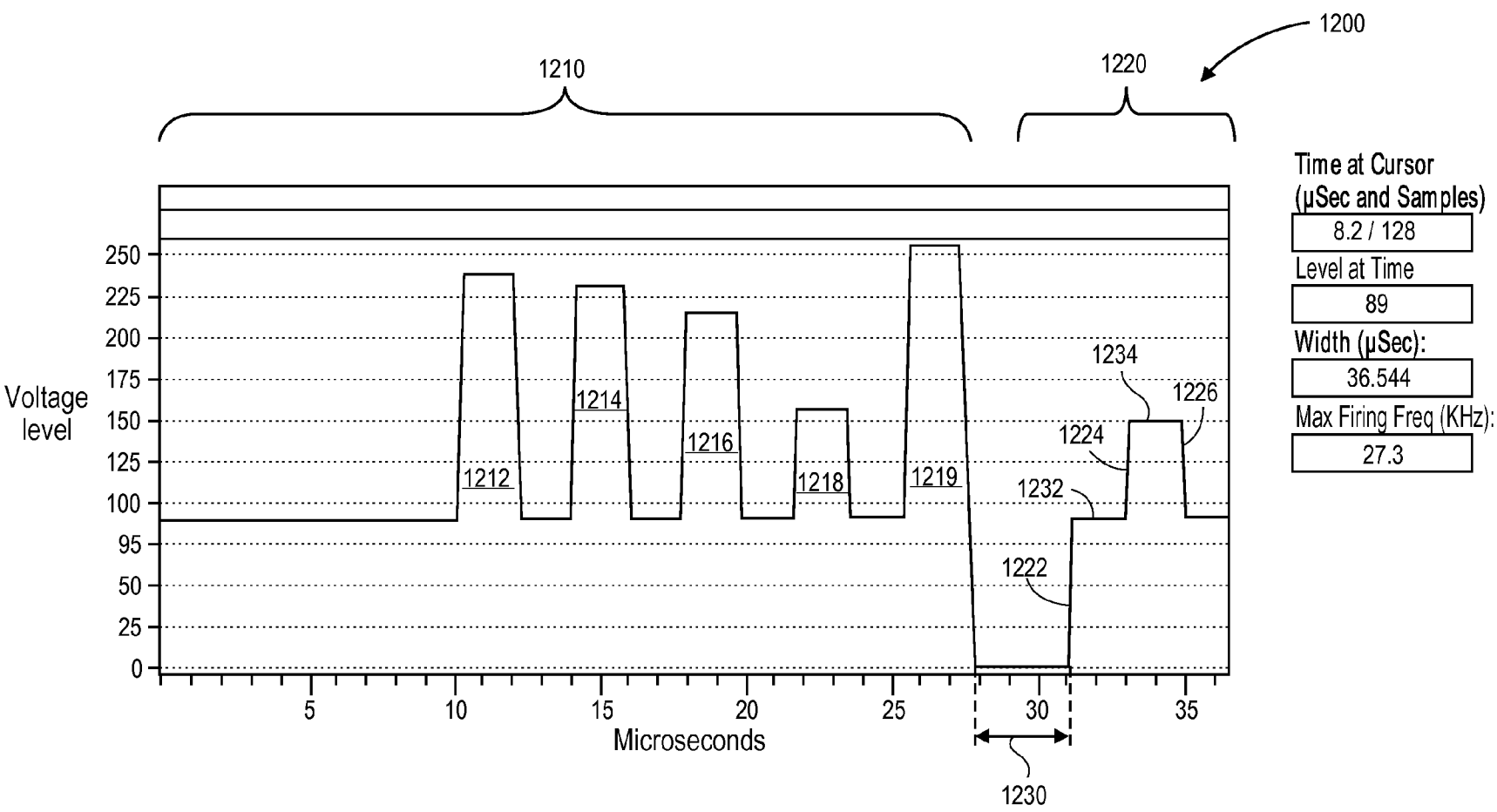
FIG. 12 shows a waveform 1200 with a drop-firing portion and a non-drop-firing portion in accordance with another embodiment.

FIG. 12 shows a waveform 1200 with a drop-firing portion and a non-drop-firing portion in accordance with one embodiment. The drop-firing portion 1210 (e.g., a first subset of the multi-pulse waveform) includes drive pulses 1212, 1214, 1216, 1218, and 1219. The non-drop-firing portion 1220 (e.g., a second subset of the multi-pulse waveform) includes a jet straightening edge 1222 having a droplet straightening function and cancellation edges 1224 and 1226 having an energy canceling function. The drive pulses cause the droplet ejection device to eject a droplet of a fluid. The cancellation edges 1224 and 1226 are fired in anti-resonance with a first edge of the drive pulse 1219. The jet straightening edge 1222 having the droplet straightening function is applied to the actuator at approximately a break-off time (i.e., time when droplet breaks off from the fluid) of the droplet to cause a meniscus of fluid of the droplet ejection device to have a desirable position (e.g., convex shape, convex shape inside nozzle that is moving towards being outside of nozzle, protruding with respect to a nozzle of the droplet ejection device). FIG. 8B illustrates one example of a favorable meniscus position. The non-drop-firing portion 1220 is designed for a drop-firing portion 1210 that has a slower or later droplet ejection.

In one embodiment, a jet straightening edge delay 1230 is a time period from a second edge of pulse 1219 and the jet straightening edge 1222. A cancel edge delay 1232 is a time period from the jet straightening edge 1222 to cancellation edge 1224. A cancel edge delay 1234 is a time period from the cancellation edge 1224 to cancellation edge 1226. In another embodiment, the straightening edge is a straightening pulse that is separate from a cancellation pulse. The cancellation edge(s) or pulse can occur prior to the straightening edge or pulse.

Figure 13:
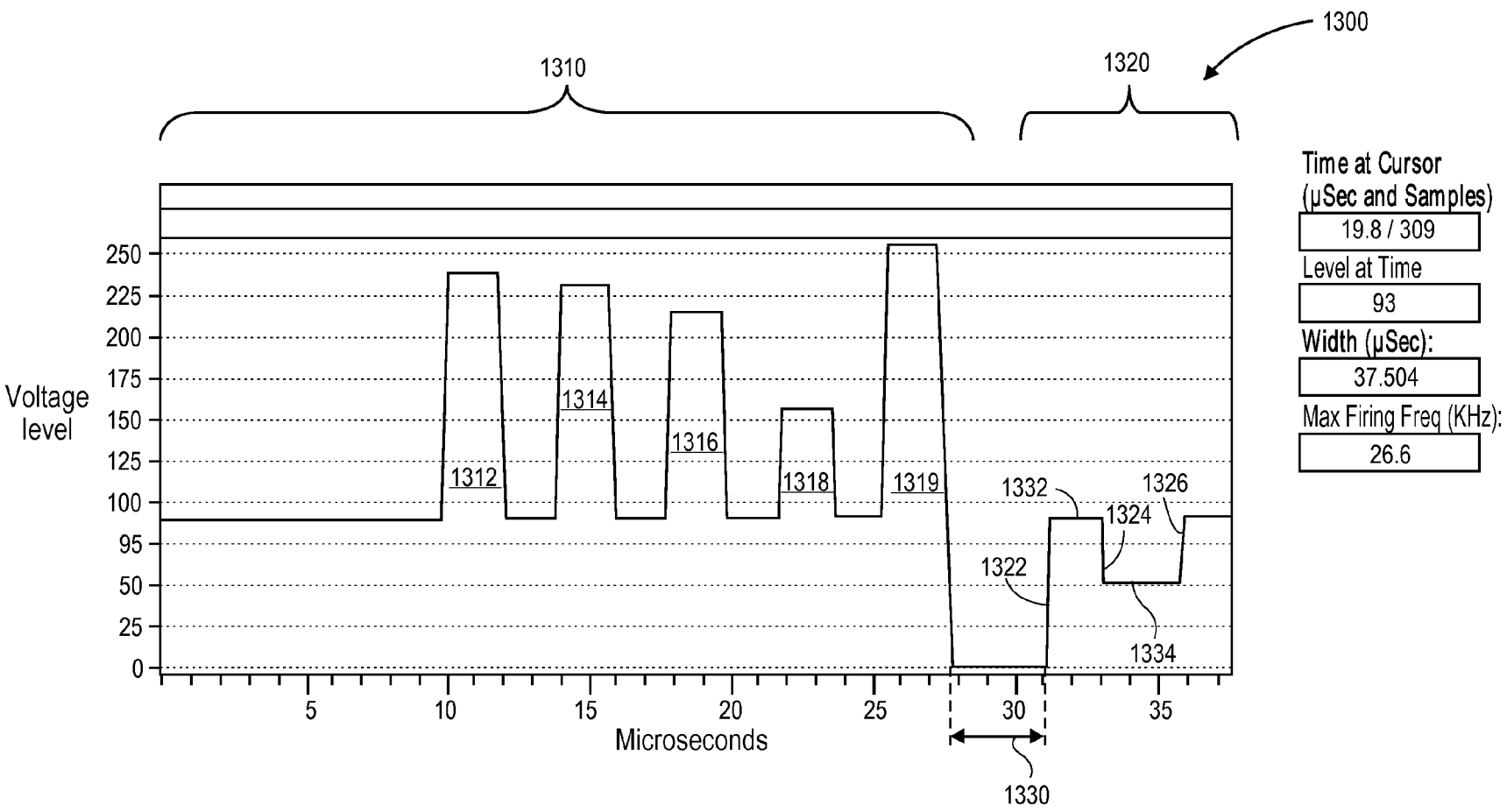
FIG. 13 shows a waveform 1300 with a drop-firing portion and a non-drop-firing portion in accordance with another embodiment.

FIG. 13 shows a waveform 1300 with a drop-firing portion and a non-drop-firing portion in accordance with one embodiment. The drop-firing portion 1310 (e.g., a first subset of the multi-pulse waveform) includes drive pulses 1312, 1314, 1316, and 1318. The non-drop-firing portion 1320 (e.g., a second subset of the multi-pulse waveform) includes jet straightening edges 1322 and 1324 having a droplet straightening function and a cancellation edge 1326 having an energy canceling function. The drive pulses cause the droplet ejection device to eject a droplet of a fluid. The cancellation edge 1326 is fired in anti-resonance with a first edge of the drive pulse 1319. The jet straightening edges having the droplet straightening function are applied to the actuator at approximately a break-off time of the droplet to cause a meniscus of fluid of the droplet ejection device to have a desirable position (e.g., convex shape, convex shape inside nozzle that is moving towards being outside of nozzle, protruding with respect to a nozzle of the droplet ejection device). The non-drop-firing portion 1320 is designed for a drop-firing portion 1310 that has a slower or later droplet ejection.

In one embodiment, a jet straightening edge delay 1330 is a time period from a second edge of pulse 1319 and the jet straightening edge 1322. A delay 1332 is a time period from the jet straightening edge 1322 to a jet straightening edge 1324. A cancel edge delay 1334 is a time period from the jet straightening edge 1324 to cancellation edge 1326. The cancellation edge 1326 or pulse can occur prior to the straightening edges.

Figure 14:
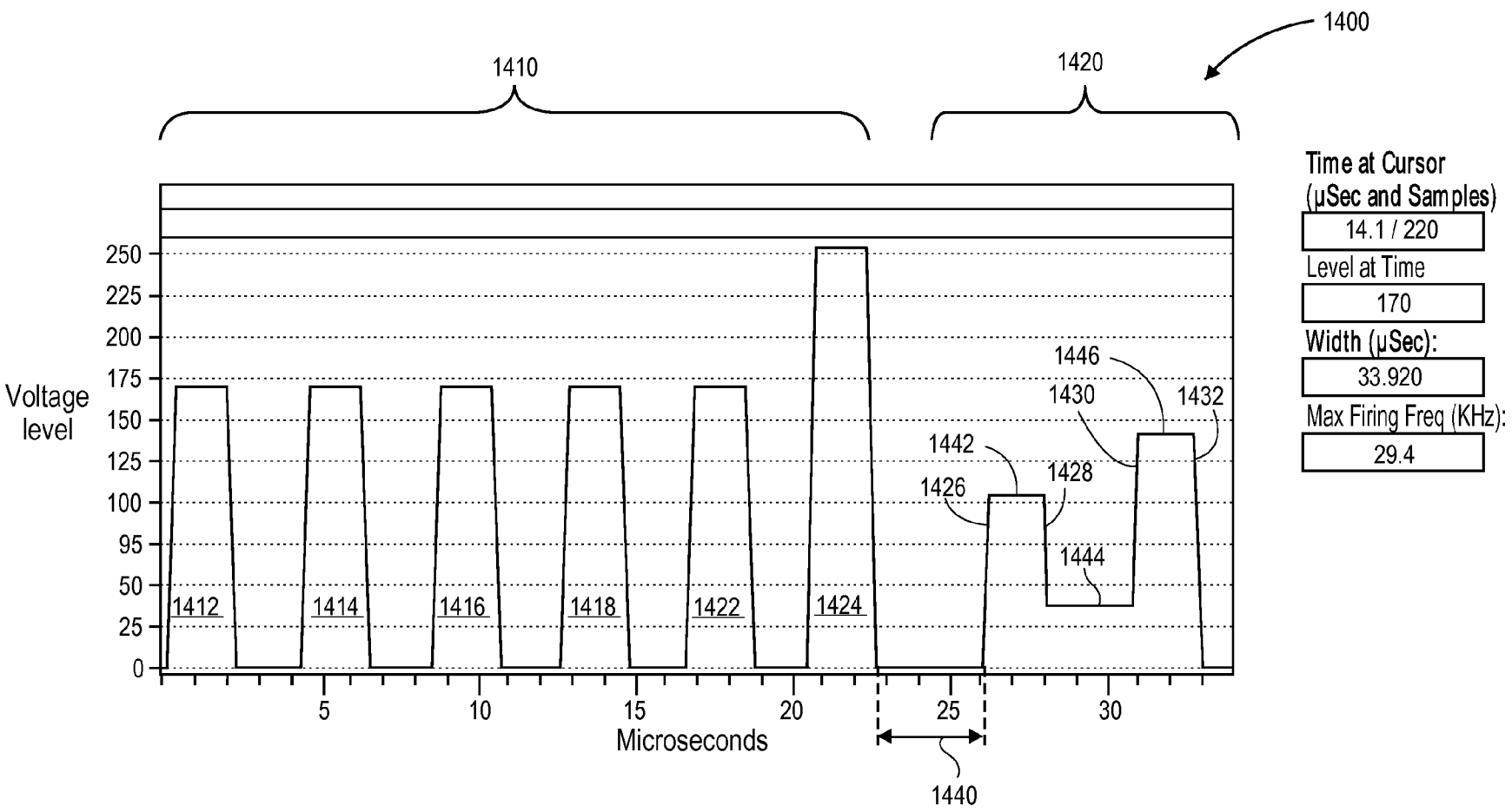
FIG. 14 shows a waveform 1400 with a drop-firing portion and a non-drop-firing portion in accordance with another embodiment.

FIG. 14 shows a waveform 1400 with a drop-firing portion and a non-drop-firing portion in accordance with one embodiment. The drop-firing portion 1410 (e.g., a first subset of the multi-pulse waveform) includes drive pulses 1412, 1414, 1416, 1418, 1422, and 1424. The non-drop-firing portion 1420 (e.g., a second subset of the multi-pulse waveform) includes jet straightening edges 1426 and 1428 having a droplet straightening function and cancellation edges 1430 and 1432 having an energy canceling function. The drive pulses cause the droplet ejection device to eject a droplet of a fluid. The cancellation edges are fired in anti-resonance with a first edge of the drive pulse 1424. The jet straightening edges having the droplet straightening function are applied to the actuator at approximately a break-off time of the droplet to cause a meniscus of fluid of the droplet ejection device to have a desirable position (e.g., convex shape, convex shape inside nozzle that is moving towards being outside of nozzle, protruding with respect to a nozzle of the droplet ejection device). The non-drop-firing portion 1420 is designed for a drop-firing portion 1410 that has a slower or later droplet ejection.

In one embodiment, a jet straightening edge delay 1440 is a time period from a second edge of pulse 1424 and the jet straightening edge 1426. A cancel edge delay 1444 is a time period from the jet straightening edge 1422 to cancellation edge 1424. A delay 1442 is a time period from the jet straightening edge 1426 and a jet straightening edge 1428. A cancel edge delay 1444 is a time period from the jet straightening edge 1428 to cancellation edge 1430. A delay 1446 is a time period from the cancellation edge 1430 to a cancellation edge 1432. The cancellation edge(s) or pulse can occur prior to the straightening edges or pulse.

A same sense cancellation pulse (or cancellation edge(s)) as illustrated in FIG. 9 is preceded by a cancel edge delay, which has a voltage level that is similar to a voltage level of one or more delays between drive pulses. An opposite sense cancellation pulse (or cancellation edge(s)) as illustrated in FIGS. 10 and 11 is preceded by a cancel edge delay, which has a voltage level that is different than a voltage level of one or more delays between drive pulses. The voltage level of the cancel edge delay is in the opposite direction, relative to the bias level or level between fire pulses, compared to the fire pulse.

The waveforms of the present disclosure can be used for a wide range of operating frequencies to advantageously provide different droplets sizes with improved meniscus control to reduce and/or eliminates a meniscus bounce and improved droplet ejection with reduced jet trajectory error and drop placement error.

It is to be understood that the above description is intended to be illustrative, and not restrictive. Many other embodiments will be apparent to those of skill in the art upon reading and understanding the above description. The scope of the invention should, therefore, be determined with reference to the appended claims, along with the full scope of equivalents to which such claims are entitled.

What is claimed is:

1. A method, comprising:

applying a multi-pulse waveform to an actuator of a droplet ejection device, the multi-pulse waveform includes a drop-firing portion having at least one drive pulse and a non-drop-firing portion having a jet straightening edge with a droplet straightening function and at least one cancellation edge having an energy canceling function for reducing residual energy within the droplet ejection device; and causing the droplet ejection device to eject a droplet of a fluid in response to the at least one drive pulse, wherein the non-drop-firing portion of the multi-pulse waveform includes the jet straightening edge in a first position followed by the at least one cancellation edge in a second position with a cancel edge delay being a time period from the first position to the second position, wherein a peak voltage of the jet straightening edge is less than a peak voltage of the at least one cancellation edge, which is less than a peak voltage of the at least one drive pulse of the drop-firing portion.

2. The method of claim 1, wherein the jet straightening edge having the droplet straightening function is applied to the actuator at approximately a break-off of the droplet to cause a meniscus of fluid to have a convex shape or to protrude with respect to a nozzle of the droplet ejection device.

3. The method of claim 1, wherein the cancel edge delay has a positive voltage level.

4. The method of claim 1, wherein the non-drop-firing portion includes the jet straightening edge and two cancellation edges.

5. The method of claim 4, wherein the jet straightening edge causes a pressure response wave that is approximately in phase with respect to pressure response waves caused by the at least one drive pulse, wherein the two cancellation edges causes pressure response waves that are approximately out of phase with respect to the pressure response waves caused by the at least one drive pulse.

6. The method of claim 1, wherein the non-drop-firing portion includes the jet straightening edge, a cancel edge delay, and a cancellation pulse.

7. A method, comprising:

applying a multi-pulse waveform to an actuator of a droplet ejection device, the multi-pulse waveform includes a drop-firing portion having at least one drive pulse and a non-drop-firing portion having a jet straightening edge with a droplet straightening function and at least one cancellation edge having an energy canceling function for reducing residual energy within the droplet ejection device; and causing the droplet ejection device to eject a droplet of a fluid in response to the at least one drive pulse, wherein the non-drop-firing portion of the multi-pulse waveform includes the jet straightening edge in a first position followed by the at least one cancellation edge in a second position with a cancel edge delay being a time period from the first position to the second position, wherein the non-drop-firing portion includes the jet straightening edge and two cancellation edges, wherein a peak voltage of the jet straightening edge is less than a peak voltage of the two cancellation edges, which is less than a peak voltage of at least one drive pulse of the drop-firing portion.

8. An apparatus, comprising:

an actuator to eject droplets of a fluid from a pumping chamber; and drive electronics coupled to the actuator, wherein during operation, the drive electronics drive the actuator by applying a multi-pulse waveform with a drop-firing portion having at least one drive pulse and a non-drop-firing portion with a jet straightening edge having a droplet straightening function and at least one cancellation edge having an energy canceling function for reducing residual energy within the droplet ejection device, and the drive electronics to cause the actuator to eject a droplet of a fluid in response to the at least one drive pulse, wherein the non-drop-firing portion of the multi-pulse waveform includes the jet straightening edge in a first position followed by the at least one cancellation edge in a second position with a cancel edge delay being a time period from the first position to the second position, wherein a peak voltage of the jet straightening edge is less than a peak voltage of the at least one cancellation edge, which is less than a peak voltage of the at least one drive pulse of the drop-firing portion.

9. The apparatus of claim 8, wherein the jet straightening edge having the droplet straightening function is applied to the actuator at approximately a break-off time of the droplet to cause a meniscus of fluid to have a convex shape or to protrude with respect to a nozzle of the droplet ejection device.

10. The apparatus of claim 8, wherein the cancel edge delay has a positive voltage level.

11. The apparatus of claim 8, wherein the non-drop-firing portion of the multi-pulse waveform includes the jet straightening edge and two cancellation edges, wherein a peak voltage of the jet straightening edge is less than a peak voltage of the two cancellation edges.

12. The apparatus of claim 8, wherein the non-drop-firing portion includes the jet straightening edge and two cancellation edges.

13. The apparatus of claim 12, wherein the jet straightening edge causes a pressure response wave that is approximately in phase with respect to pressure response waves caused by the at least one drive pulse, wherein the two cancellation edges causes pressure response waves that are approximately out of phase with respect to the pressure response waves caused by the at least one drive pulse.

14. A printhead, comprising:

an ink jet module that comprises, an actuator to eject droplets of a fluid from a pumping chamber; and drive electronics coupled to the actuator, wherein during operation, the drive electronics drive the actuator by applying a multi-pulse waveform with a drop-firing portion having at least one drive pulse and a non-drop-firing portion with at least one jet straightening edge having a droplet straightening function and at least one cancellation edge having an energy canceling function for reducing residual energy within the droplet ejection device, and the drive electronics to cause the actuator to eject a droplet of a fluid in response to the at least one drive pulse, wherein the non-drop-firing portion of the multi-pulse waveform includes the at least one jet straightening edge in a first followed by the at least one cancellation edge, wherein a peak voltage of the at least one jet straightening edge is less than or approximately equal to a peak voltage of the at least one cancellation edge, which is less than a peak voltage of the at least one drive pulse of the drop-firing portion.

15. The printhead of claim 14, wherein the at least one jet straightening edge having the droplet straightening function is applied to the actuator at approximately a break-off time of the droplet to cause a meniscus of fluid to have a convex shape or to protrude with respect to a nozzle of the printhead.

16. The printhead of claim 14, wherein a cancel edge delay being a time period from the at least one jet straightening edge to the at least one cancellation edge has a positive voltage level.

17. The printhead of claim 14, wherein the non-drop-firing portion of the multi-pulse waveform includes the at least one jet straightening edge and two cancellation edges, wherein a peak voltage of the at least one jet straightening edge is less than a peak voltage of the two cancellation edges.

18. The printhead of claim 14, wherein the non-drop-firing portion includes one jet straightening edge and two cancellation edges.

19. The printhead of claim 14, wherein the at least one cancellation edge causes one or more pressure response waves that are approximately out of phase with respect to one or more pressure response waves caused by the at least one drive pulse.

20. The method of claim 3, wherein the cancel edge delay is a time period from the jet straightening edge to a first cancellation edge of the at least one cancellation edge if the at least one cancellation edge includes the first cancellation edge and a second cancellation edge.

21. The method of claim 1, wherein the non-drop-firing portion of the multi-pulse waveform includes the jet straightening edge and two cancellation edges, wherein a peak voltage of the jet straightening edge is less than a peak voltage of the at least one cancellation edge.

* * * * *